US010533806B2

(12) United States Patent
Klingenburg

(10) Patent No.: US 10,533,806 B2
(45) Date of Patent: Jan. 14, 2020

(54) ROTARY HEAT EXCHANGER

(71) Applicant: KLINGENBURG GmbH, Gladbeck (DE)

(72) Inventor: Kai Klingenburg, Essen (DE)

(73) Assignee: KLINGENBURG GMBH, Gladbeck (DE)

( * ) Notice: Subject to any disclaimer, the term of this patent is extended or adjusted under 35 U.S.C. 154(b) by 0 days.

(21) Appl. No.: 15/741,540

(22) PCT Filed: Sep. 16, 2015

(86) PCT No.: PCT/EP2015/001848
§ 371 (c)(1),
(2) Date: Jan. 19, 2018

(87) PCT Pub. No.: WO2017/016570
PCT Pub. Date: Feb. 2, 2017

(65) Prior Publication Data

US 2018/0187976 A1 Jul. 5, 2018

(30) Foreign Application Priority Data

Jul. 30, 2015 (DE) ..... 20 2015 005 300 U

(51) Int. Cl.
*F28D 19/04* (2006.01)

(52) U.S. Cl.
CPC ..... *F28D 19/041* (2013.01); *F28D 19/047* (2013.01); *F24F 2203/104* (2013.01); *F24F 2203/1096* (2013.01); *F28F 2230/00* (2013.01)

(58) Field of Classification Search
CPC ..... F28D 19/04; F28D 19/41; F28D 19/42; F28D 19/44; F28D 19/47; F24F 2203/104; F24F 2203/1068; F24F 2203/1096
See application file for complete search history.

(56) References Cited

U.S. PATENT DOCUMENTS 5,002,116 A 3/1991 Hoagland
5,069,272 A 12/1991 Chagnot
(Continued)

FOREIGN PATENT DOCUMENTS

WO WO-8808112 A1 * 10/1988 ..... F24F 3/1423

*Primary Examiner* — Eric S Ruppert
(74) *Attorney, Agent, or Firm* — Andrew Wilford

(57) ABSTRACT

A rotary heat exchanger through which a first fluid flow—an outside air or inlet air flow, for example—and a second fluid flow—an exit air or outgoing air flow, for example—can flow in a counterflow configuration, has a rotatably mounted rotor (5) that has a first flow sector for the first fluid flow and a second flow sector for the second fluid flow through which the rotor (5) passes during a rotation, a frame in which the rotor (5) is rotatably supported, and a sealing assembly (9) by means of which an inflow side of the first fluid flow and an outflow side of the second fluid flow can be separated from the outflow side of the first fluid flow and from an inflow side of the second fluid flow, respectively. In order to simplify the sealing assembly, with the aim being that a reliable seal between the inflow and outflow sides of the two fluid flows be automatically ensured during operation of the rotary heat exchanger, it is proposed that the sealing assembly (9) have a first seal (12) that bears sealingly against the side of a partition (10) directed upstream into the first fluid flow (2), and a second seal (13) that bears sealingly against the side of the same partition (10) directed upstream into the second fluid flow (3).

5 Claims, 2 Drawing Sheets

(56) References Cited

U.S. PATENT DOCUMENTS

| | | | | | |
|---|---|---|---|---|---|
| 5,183,098 | A * | 2/1993 | Chagnot | ..... | F24F 3/1423 165/54 |
| 5,238,052 | A * | 8/1993 | Chagnot | ..... | F24F 3/1423 165/54 |
| 5,285,842 | A * | 2/1994 | Chagnot | ..... | F24F 3/1423 165/10 |
| 5,577,551 | A | 11/1996 | Kritzler | | |
| 5,655,594 | A | 8/1997 | Wonderling | | |
| 2006/0278364 | A1 | 12/2006 | Struensee | | |

* cited by examiner

ROTARY HEAT EXCHANGER

CROSS REFERENCE TO RELATED APPLICATIONS

This application is the US-national stage of PCT application PCT/EP2015/001848 filed 16 Sep. 2015 and claiming the priority of German patent application 202015005300.9 itself filed 30 Jul. 2015.

FIELD OF THE INVENTION

The invention relates to a rotary heat exchanger through which a first fluid stream, for example an outside air or inlet air stream, and a second fluid stream, for example an exit air or outgoing air stream, can flow in a counterflow configuration.

BACKGROUND OF THE INVENTION

Such a rotary heat exchanger typically has with a rotatably mounted rotor and forms a first flow sector for the first fluid stream and a second flow sector for the second fluid stream through which the rotor passes during a rotation, a frame in which the rotor is rotatably supported, and a sealing assembly that separates an inflow side of the first fluid stream and an outflow side of the second fluid stream respectively from the outflow side of the first fluid stream and from an inflow side of the second fluid stream.

During operation of such a rotary heat exchanger, the rotor, which is a rotating storage mass, must be sealed relative to the housing and the frame of the rotary heat exchanger. Moreover, the two fluid flows upstream and downstream from the rotary heat exchanger must also be separated from and sealed with respect one another. Leakage during operation of the rotary heat exchanger can be prevented for the most part by these sealing measures.

It is necessary for such leakage to be prevented, since the supply air quality is otherwise reduced, for example, because components of the exhaust air get into the inlet air stream; what is more, leaks occur from the outside air into the outgoing air, for example, where higher-powered fans need to be installed for the outside air and/or inlet air stream, since greater quantities of air must be conveyed than are actually required in order to achieve the desired inlet air volume; disturbances also arise with respect to the recovery performance of the rotary heat exchanger, since bypass flows that flow around the rotor or storage mass reduce the overall performance of the rotary heat exchanger.

On the other hand, certain gaps or spaces are necessary between the rotor forming the heat-storage mass and the housing and/or frame parts that are stationary relative to it, since deviations of the rotor forming the storage mass from the ideal cylinder shape and other construction tolerances would inevitably lead to unwanted friction and result in damage. The gaps and spaces that are therefore necessary must be sealed by the sealing assembly of the rotary heat exchanger.

OBJECT OF THE INVENTION

Starting from the prior art described above, it is the object of the invention to further develop the rotary heat exchanger described above such that the sealing assembly thereof can be simplified, with a reliable seal between the inflow and outflow sides of the two fluid flows being automatically ensured during operation of the rotary heat exchanger.

SUMMARY OF THE INVENTION

This object is achieved according to the invention by virtue of the fact that the sealing assembly has a first seal that bears sealingly against the side of a partition directed upstream into the first fluid stream, and a second seal that bears sealingly against the opposite side of the same partition directed upstream into the second fluid stream. In order to ensure the sealing function in the area of the rotary heat exchanger, it is thus only necessary to have a single partition that is extends radially of the rotor and seals the rotor or storage mass with respect to the frame. Due to the pressure conditions within the rotary heat exchanger, in whose rotor or storage mass each of the two fluid flows flowing through the rotor in a counterflow configuration experiences a drop in pressure, a sealing effect is automatically created between the partition and the two seals, with this sealing effect being produced in the first flow sector by the first fluid stream and in the second flow sector by the second fluid stream, each of which presses the respective seal with against the single partition, particularly on different sides or faces of the partition. This results in a nearly gap-free seal with extremely low friction losses. In the embodiment of the sealing assembly with only one partition, the differential pressures on the seals are smaller and independent of the differential pressure between the two fluid flows. The differential pressure on the sealing assembly, provided that it is embodied with only one partition, is always equal to the pressure loss of the respective fluid flow in the rotor forming the storage mass; accordingly, this differential pressure always causes the seal to be pressed against the partition in the respective direction of fluid flow.

Advantageously, the partition is axially spaced from the two axial end faces on the cylindrical outer edge surface of the rotor and has a circular cutout whose inside diameter slightly exceeds the outside diameter of the rotor. Accordingly, the space between the cylindrical outer edge surface of the rotor on the one hand and the frame on the other hand can be utilized for the installation and/or assembly of the sealing assembly, with it being possible to avoid having portions or components of the sealing assembly projecting over the axial end faces of the rotor forming the storage mass.

Accordingly, it can also be advantageous to provide the partition in the center between the two axial end faces on the cylindrical outer edge surface of the rotor.

According to an advantageous development of the rotary heat exchanger according to the invention, its first seal is annular and has an axially extending part seated on the cylindrical outer edge surface of the rotor, and a radially extending part bearing axially on the face of the partition directed upstream into the first fluid stream.

A commensurately advantageous embodiment is achieved with respect to the second seal if it is also annular and has an axially extending part seated on the cylindrical outer edge surface of the rotor, and a radially extending part bearing axially on the face of the partition directed upstream into the second fluid stream.

In order to ensure a reliable sealing effect for all types of application and use of the rotary heat exchanger, it is advantageous if both seals are fixed by their axially extending parts on the cylindrical outer edge surface of the rotor and can be brought into sliding and sealing abutment with their radially extending parts against the side of the partition that is respectively associated with them. In this embodiment, it is also advantageous for both seals to extend around the entire periphery of the rotor on the cylindrical edge surface thereof, because, due to the rotation of the rotor or storage mass, every circumferential portion of the seals enters into both flow sectors or fluid flows and is thus subjected to opposing pressure differences. Moreover, due to the bilateral arrangement of the seals over the entire periphery of the cylindrical edge surface of the storage mass or rotor, the stability is increased when the rotary heat exchanger is operated with high pressure losses and commensurately high pressure differentials on the sealing assembly.

The seals of the sealing assembly of the rotary heat exchanger according to the invention are advantageously made of an abrasion-resistant and flexible material that is impermeable to fluids, such as an artificial leather material, an extruded plastic, or the like, so that the axially extending parts of the seals can be fixed on the cylindrical outer edge surface of the rotor and the radially extending parts of the seals can be brought into sliding and sealing abutment against the respective axially directed side or face of the partition.

During the manufacture of the sealing assembly or of the rotary heat exchanger, if both the installed position of the rotor or storage mass and the direction of the fluid flows that flow through the rotary heat exchanger in a counterflow configuration are known, it is possible to design both seals such that they can be brought into sliding and sealing abutment with their axially extending parts against the cylindrical outer edge surface of the rotor and fixed by their radially extending parts on the side of the partition with which they are respectively associated. With a corresponding set of requirements, the seal can then be provided exclusively on the respective inflow side of the flow sectors of the partition, since a higher pressure is always present on the inflow side than on the outflow side.

In such embodiments of the heat exchanger according to the invention, the first semicircular seal is fastened on the partition and arranged so as to slide on the cylindrical outer edge surface of the rotor and extends only over a circumferential portion of the circular cutout of the partition that is associated with the flow sector of the first fluid stream.

Accordingly, the second semicircular seal is also fastened on the partition and arranged so as to slide on the cylindrical outer edge surface of the rotor, with the second seal extending only over a circumferential portion of the circular cutout of the partition that is associated with the flow sector of the second fluid stream.

BRIEF DESCRIPTION OF THE DRAWING

The invention will be explained below in further detail on the basis of an embodiment with reference to the drawing.

SPECIFIC DESCRIPTION OF THE INVENTION

Figure 1:
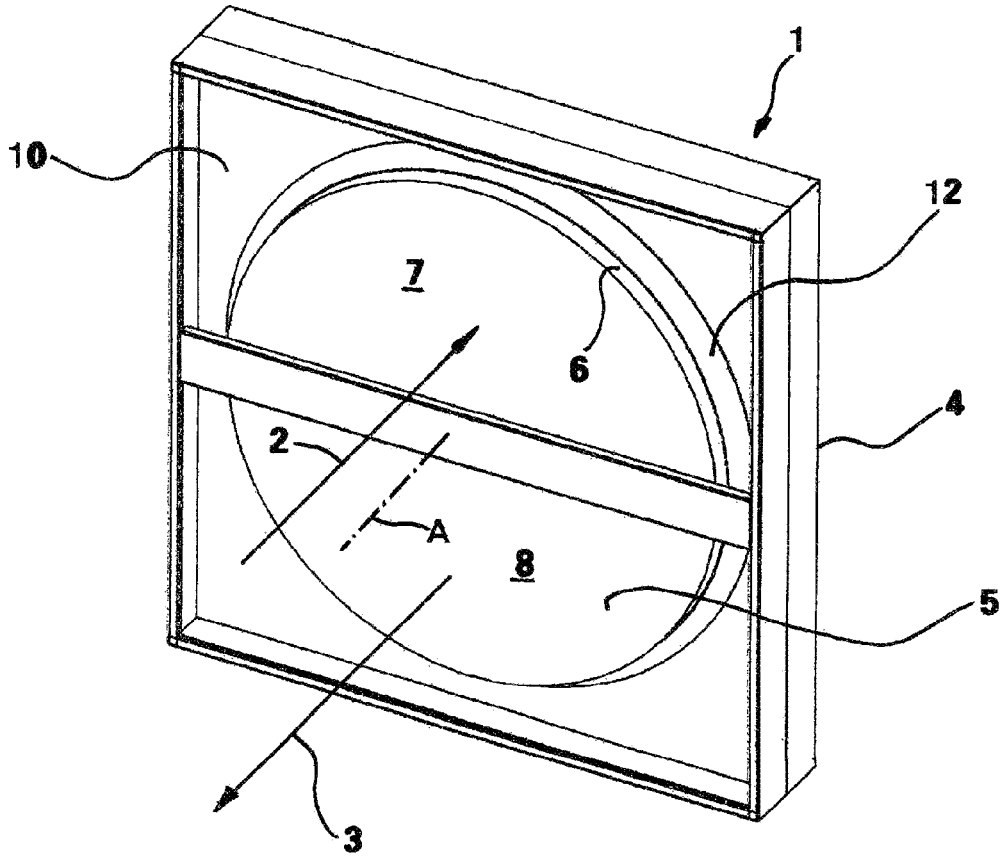
FIG. 1 is a perspective schematic view of an embodiment of a rotary heat exchanger according to the invention.
Figure 2:
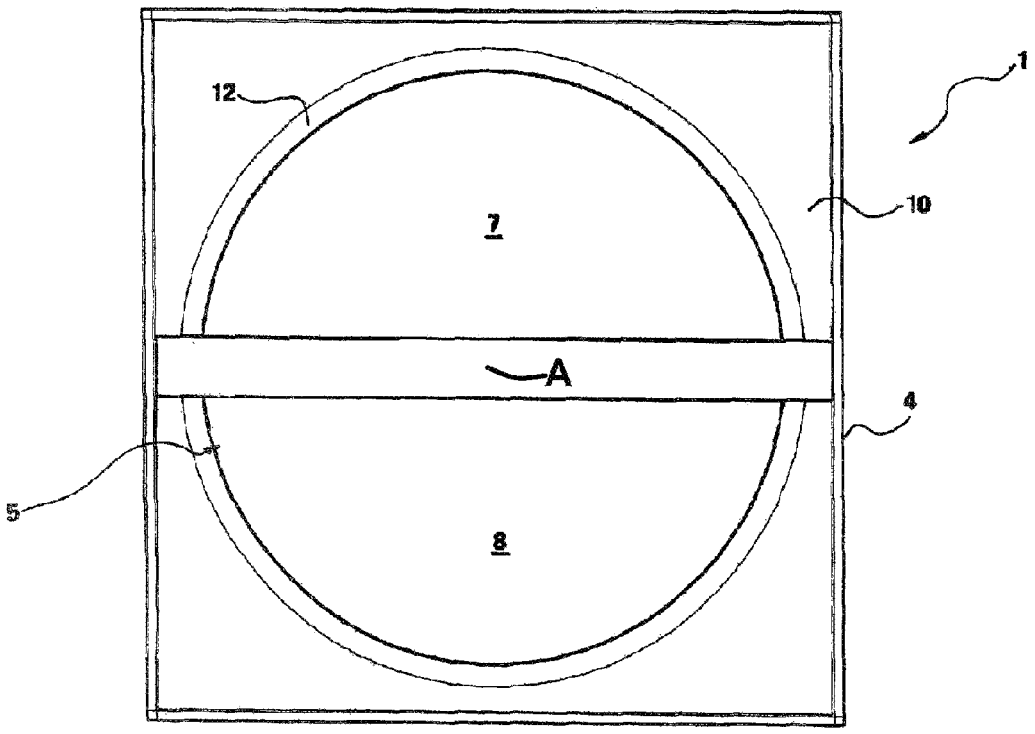
FIG. 2 is a front view of the embodiment of the rotary heat exchanger according to the invention shown in FIG. 1.

Two fluid flows 2, 3 flow axially in opposite directions through a rotary heat exchanger 1 according to the invention, of which a perspective and a front view are shown in respective FIGS. 1 and 2. The first fluid stream 2 is an outside air or inlet air stream 2, and the second fluid stream 3 is an exhaust air or outgoing air stream 3. The two fluid flows 2 and 3 are illustrated in FIG. 1 by directional arrows.

In the illustrated embodiment, the rotary heat exchanger 1 has a frame 4 with an approximately square outer periphery. This frame 4 surrounds the outer periphery of a rotor 5 of the rotary heat exchanger 1. The rotor 5 has a cylindrical outer lateral edge surface 6 that can for example be formed by a suitable sheet metal.

Moreover, the heat exchanger 1 defines a first flow sector 7 through which the outside air or inlet air stream flows as shown in FIG. 1. The exchanger 1 also has a second flow sector 6 through which the exhaust or outgoing air stream 3 flows in an axial direction opposite the outside or inlet air stream 2.

The rotor 5 of the rotary heat exchanger 1 is rotationally carried on an unillustrated bearing or hub.

In the rotary heat exchanger 1, an inflow side of the outside air or inlet air stream 3 is sealed from the outflow side thereof. Similarly, the outflow side of the exhaust air or outgoing air stream 3 is tightly sealed from an inflow side thereof in the rotary heat exchanger 1. It should be pointed out that, in FIGS. 1 and 2, the rotary heat exchanger 1 is viewed from the inflow side of the outside air or inlet air stream 2 and an outflow side of the exhaust air or outgoing air stream 3.

A sealing assembly 9 is in the frame 4 of the rotary heat exchanger 1 that separates the inflow and outflow sides of the outside air or inlet air stream 2 and of the exhaust air or outgoing air stream 3 from one another.

It should be noted here that, as will readily be understood, a separating wall (not shown in the figures) is provided extending axially upstream and downstream from the rotary heat exchanger 1 for separating the outside air or inlet air stream 2 upstream and downstream from the rotary heat exchanger 1 from the exhaust air or outgoing air stream 3.

The sealing assembly 9 that is provided in the frame 4 has a partition 10 whose outer periphery fits with the inner periphery of the frame 4 and is fastened there.

The partition 10 is provided with a circular cutout 11 in its center region. The inner diameter of the circular cutout 11 of the partition 10 corresponds substantially to the outer diameter of the rotor 5 of the rotary heat exchanger 1 but is slightly larger, so that manufacturing tolerances occurring during the manufacture of the rotor 5 cannot possibly result in friction and the like and resulting damage.

Nevertheless, in order to tightly separate the inflow and outflow sides from one another by means of the partition within the rotary heat exchanger 1, the sealing assembly 9 also has a first seal in the form of a first annular seal lip 12 and a second seal in the form of a second annular seal lip 13.

In the illustrated embodiment of the rotary heat exchanger 1, the first annular seal lip 12 is on the inside diameter of the circular cutout 11 of the partition 10 on the inflow side of the outside air or inlet air stream 2 and analogously on the outflow side of the exhaust air or outgoing air stream 3. Similarly, the second annular seal lip 13 is on the inside diameter of the circular cutout 11 of the partition 10 on the outflow side of the outside air or inlet air stream 2 and the inflow side of the exhaust air or outgoing air stream 3, as can be seen particularly in FIG. 3, which will be explained in further detail below.

In the illustrated embodiment, the two annular seal lips 12 and 13 extend around the entire periphery of the rotor 5 on its cylindrical outer edge surface 6.

The partition 10 and the two annular seal lips 12 and 13 are axially spaced from the respective end faces of the rotor 5 against or from its cylindrical outer edge surface 6.

The first annular seal lip 12 has an axially extending part 14 that extends axially of the rotor 5 and is seated on the cylindrical outer edge surface 6 of the rotor 5 and tightly fastened or mounted there. Moreover, the first annular seal lip has a radially extending sealing portion 15 that extends radially of the rotor 5 and engages the upstream axial face of the partition 10 that is on the inflow side of the outside or inlet air stream 2 and can be brought into sealing abutment against this face of the partition 10.

Figure 3:
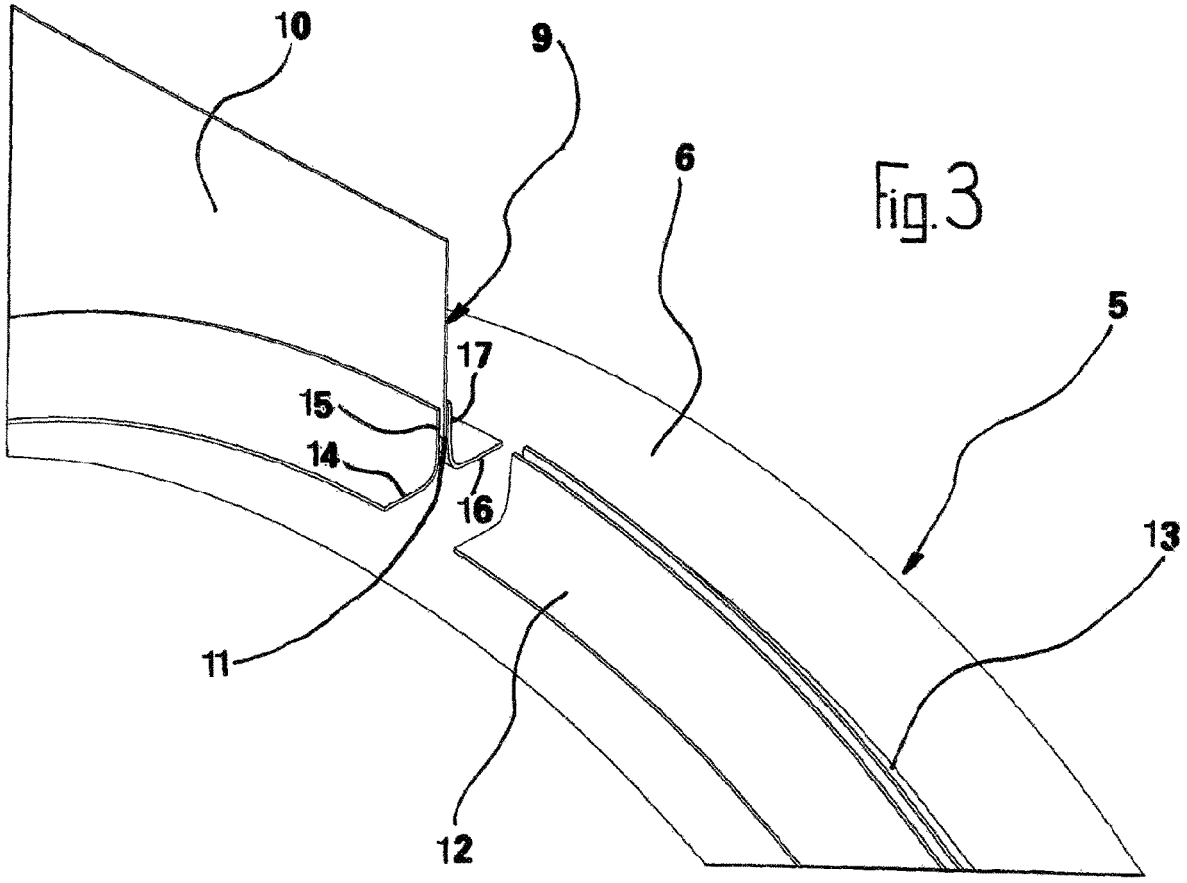
FIG. 3 is a partial, perspective schematic view of a detail of the embodiment of the rotary heat exchanger according to the invention shown in FIGS. 1 and 2 that are essential for the invention.

Similarly as can be seen particularly from FIG. 3, the second annular seal lip 13 is on the outflow side of the outside air or inlet air stream 2 and thus the inflow side of the exhaust air or outgoing air stream 3 of the partition 10 and has an axially extending part 16 that is extends axially of the rotor 5, is seated on the cylindrical outer edge surface 6 of the rotor 5 and is tightly fastened or mounted there, and a radially extending part 17 that extends radially of the rotor 5, engages the upstream face of the exhaust air or outgoing air stream 3 of the partition 10 and can be brought into sealing abutment there against this face of the partition 10.

The two annular seal lips 12 and 13 are made of a suitable abrasion-resistant and flexible material that is impermeable to fluids, such as an artificial leather material, an extruded plastic, or the like. Accordingly, the axially extending parts 14 and 16 of the two annular seal lips 12, 13 can be fixed securely on the cylindrical outer edge surface 6 of the rotor, and the radially extending parts 15 and 17 of the two annular seal lips 12, 13 can be simultaneously brought into sliding and sealing abutment against the face of the partition 10 with which they are associated.

Since the seal between inflow and outflow sides is accomplished by only a single partition 10 in the case of the embodiment of the rotary heat exchanger 1 according to the invention described above, the pressure differentials on the annular seal lips 12 and 13 are relatively small and, furthermore, independent of the pressure differentials between the outside air or inlet air stream 2 on the one hand and the exhaust air or outgoing air stream 3 on the other hand. By virtue of the design of the sealing assembly 9 with a single partition 10, the pressure differential on the annular seal lips 12 and 13 is always equal to the pressure loss of the outside air or inlet air stream 2 and, accordingly, of the exhaust air or outgoing air stream 3, as it occurs on the rotor 5 forming the storage mass. Accordingly, in both flow sectors 7 and 8 of the rotor 5, a pressing of the radially extending part 15 of the first annular seal lip 12 against the side of the partition 10 facing toward the inflow side of the outside air or inlet air stream 2 and of the radially extending part 17 of the second annular seal lip 13 against the side of the partition 10 facing toward the inflow side of the exhaust air or outgoing air stream 3 is achieved, with the consequence that a reliable seal is achieved between the inflow and outflow sides both with respect to the outside air or inlet air stream 2 and the exhaust air or outgoing air stream 3.

The manner in which the two seal lips 12 and 13 are fastened on the cylindrical outer edge surface 6 follows from the schematic view shown in FIG. 3 of a portion of the cylindrical outer edge surface 6 of the rotor 5, for which the partition 10 and the two annular seal lips 12 and 13 are also shown only partially. The gap in the two annular seal lips 12 and 13 in approximately the center of the figure is shown merely for purpose of illustration in order to clarify the arrangement or fitting-together of cylindrical outer edge surface 6, the two annular seal lips 12 and 13, and the partition 10.

The partition 10 is seated between the two radial portions 15 and 17 of the two annular seal lips 12 and 13 and extends, like the two seal lips 12 and 13, around the entire periphery of the cylindrical outer edge surface 6 of the rotor 5.

In an alternative embodiment of the rotary heat exchanger according to the invention, for the use of which both the installed position and the direction of the two fluid flows 2 and 3 are known, it is possible to mount the two seal lips on the partition 10. If the two seal lips do not move with the rotor, it is sufficient if corresponding seal lips are provided only on the inflow side in the two flow sectors, since greater pressure is always present on the inflow side than on the outflow side.

As will readily be understood, unlike in the view in FIG. 3, the partition 10 can also be arranged approximately or exactly in the center of the rotor 5, seen axially.

The invention claimed is:

1. A rotary heat exchanger through which a first fluid stream and a second fluid stream can flow along an axis in a counterflow configuration, the heat exchanger comprising:

a frame;

a partition in the frame having axially opposite end faces and formed on the axis with a circular cutout through which the streams flow axially oppositely;

a rotor that extends axially through the cutout, that is rotatable about an axis in the frame, that passes through a first flow sector for the first fluid stream and a second flow sector for the axially oppositely flowing second fluid stream during a rotation, and that has a radially outwardly directed cylindrical edge surface, an L-section and flexible annular first seal having a part that extends axially and is fixed to the edge surface of the rotor and a part that extends radially and that is of such flexibility as to be pressed axially sealingly by the first fluid stream against the face of the partition directed upstream into the first fluid stream; and an L-section and flexible annular second seal having a part that extends axially and is fixed to the edge surface of the rotor and a part that is of such flexibility as to be pressed axially sealingly by the second fluid stream against the opposite face of the partition directed upstream into the second fluid stream.

2. The rotary heat exchanger defined in claim 1, wherein the partition is axially spaced from two axial end faces of the rotor on the cylindrical outer edge surface of the rotor and the circular cutout has an inside diameter slightly greater than an outside diameter of the rotor at the outer cylindrical surface.

3. The rotary heat exchanger defined in claim 2, wherein the partition is centered equidistant between the two axial end faces of the rotor on the cylindrical outer edge surface of the rotor.

4. The rotary heat exchanger defined in claim 1, wherein the seals are made of an abrasion-resistant and flexible material that is impermeable to fluids, so that the axially extending parts of the seals can be fixed on the cylindrical outer edge surface of the rotor and the radially extending parts of the seals can be brought into sliding and sealing abutment against the respective side of the partition.

5. The rotary heat exchanger defined in claim 1, wherein the first seal and the second seal run annularly completely around the rotor on the cylindrical edge surface.

* * * * *